US007329382B2

(12) United States Patent
Amick

(10) Patent No.: US 7,329,382 B2
(45) Date of Patent: Feb. 12, 2008

(54) METHODS FOR PRODUCING MEDIUM-DENSITY ARTICLES FROM HIGH-DENSITY TUNGSTEN ALLOYS

(76) Inventor: Darryl D. Amick, 3227 Countryman Cir., NW., Albany, OR (US) 97321

( * ) Notice: Subject to any disclaimer, the term of this patent is extended or adjusted under 35 U.S.C. 154(b) by 358 days.

(21) Appl. No.: 11/114,633

(22) Filed: Apr. 25, 2005

(65) Prior Publication Data

US 2005/0188790 A1 Sep. 1, 2005

Related U.S. Application Data

(63) Continuation of application No. 10/238,770, filed on Sep. 9, 2002, now Pat. No. 6,884,276, which is a continuation of application No. 09/483,073, filed on Jan. 14, 2000, now Pat. No. 6,477,715.

(51) Int. Cl.
*C22C 1/04* (2006.01)
*C22C 27/04* (2006.01)

(52) U.S. Cl. ..... 419/33; 102/517; 75/246

(58) Field of Classification Search ..... 75/246
See application file for complete search history.

(56) References Cited

U.S. PATENT DOCUMENTS

| | | | |
|---|---|---|---|
| 1,847,617 | A | 3/1932 | Löwenstein et al. |
| 2,119,876 | A | 6/1938 | Corson |
| 2,183,359 | A | 12/1939 | Smithells |
| 2,919,471 | A | 1/1960 | Hechinger |
| 2,995,090 | A | 8/1961 | Daubenspeck |
| 3,123,003 | A | 3/1964 | Lange, Jr. et al. |
| 3,372,021 | A | 3/1968 | Forbes et al. |
| 3,623,849 | A | 11/1971 | Benjamin |
| 3,785,801 | A | 1/1974 | Benjamin |
| 3,888,636 | A | 6/1975 | Sczerzenie et al. |
| 3,890,145 | A | 6/1975 | Hivert et al. |
| 3,953,194 | A | 4/1976 | Hartline, III et al. |
| 3,979,234 | A | 9/1976 | Northcutt, Jr. et al. |
| 4,027,594 | A | 6/1977 | Olin et al. |

(Continued)

FOREIGN PATENT DOCUMENTS

| | | |
|---|---|---|
| CA | 521944 | 2/1956 |

(Continued)

OTHER PUBLICATIONS

"Milling of Brittle and Ductile Materials," ASM Handbook, vol. 7, pp. 53-66.*

(Continued)

*Primary Examiner*—Roy King
*Assistant Examiner*—Christopher Kessler
(74) *Attorney, Agent, or Firm*—Kolisch Hartwell, P.C.

(57) ABSTRACT

Methods for producing medium-density articles from recovered high-density tungsten alloy (WHA) material, and especially from recovered WHA scrap. In one embodiment of the invention, the method includes forming a medium-density alloy from WHA material and one or more medium- to low-density metals or metal alloys. In another embodiment, medium-density grinding media, such as formed from the above method, is used to mill WHA scrap and one or more matrix metals into particulate that may be pressed and, in some embodiments, sintered to form medium-density articles therefrom.

15 Claims, 6 Drawing Sheets

U.S. PATENT DOCUMENTS

| | | | |
|---|---|---|---|
| 4,035,115 | A | 7/1977 | Hansen |
| 4,035,116 | A | 7/1977 | O'Brien et al. |
| 4,138,249 | A | 2/1979 | Rosof |
| 4,252,577 | A | 2/1981 | Malard |
| 4,274,940 | A | 6/1981 | Plancqueel et al. |
| 4,338,126 | A | 7/1982 | Vanderpool et al. |
| 4,383,853 | A | 5/1983 | Zapffe |
| 4,428,295 | A | 1/1984 | Urs |
| 4,488,959 | A | 12/1984 | Agar |
| 4,760,794 | A | 8/1988 | Allen |
| 4,762,559 | A | 8/1988 | Penrice et al. |
| 4,780,981 | A | 11/1988 | Hayward et al. |
| 4,784,690 | A | 11/1988 | Mullendore |
| 4,881,465 | A | 11/1989 | Hooper et al. |
| 4,897,117 | A | 1/1990 | Penrice |
| 4,931,252 | A | 6/1990 | Brunisholz et al. |
| 4,940,404 | A | 7/1990 | Ammon et al. |
| 4,949,644 | A | 8/1990 | Brown |
| 4,949,645 | A | 8/1990 | Hayward et al. |
| 4,960,563 | A | 10/1990 | Nicolas |
| 4,961,383 | A | 10/1990 | Fishman et al. |
| 4,990,195 | A | 2/1991 | Spencer et al. |
| 5,069,869 | A | 12/1991 | Nicolas et al. |
| 5,088,415 | A | 2/1992 | Huffman et al. |
| 5,264,022 | A | 11/1993 | Haygarth et al. |
| 5,279,787 | A | 1/1994 | Oltrogge |
| 5,399,187 | A | 3/1995 | Mravic et al. |
| 5,527,376 | A | 6/1996 | Amick et al. |
| 5,713,981 | A | 2/1998 | Amick |
| 5,719,352 | A | 2/1998 | Griffin |
| 5,740,516 | A | 4/1998 | Jiranek, II et al. |
| 5,760,331 | A | 6/1998 | Lowden et al. |
| 5,774,780 | A | 6/1998 | Prause |
| 5,786,416 | A | 7/1998 | Gardner et al. |
| 5,814,759 | A | 9/1998 | Mravic et al. |
| 5,820,707 | A | 10/1998 | Amick et al. |
| 5,831,188 | A | 11/1998 | Amick et al. |
| 5,847,313 | A | 12/1998 | Beal |
| 5,868,879 | A | 2/1999 | Amick et al. |
| 5,877,437 | A | 3/1999 | Oltrogge |
| 5,905,936 | A | 5/1999 | Fenwick et al. |
| 5,913,256 | A | 6/1999 | Lowden et al. |
| 5,917,143 | A | 6/1999 | Stone |
| 5,922,978 | A | 7/1999 | Carroll |
| 5,950,064 | A | 9/1999 | Robinson et al. |
| 5,963,776 | A | 10/1999 | Lowden et al. |
| 6,048,379 | A | 4/2000 | Bray et al. |
| 6,090,178 | A | 7/2000 | Benini |
| 6,112,669 | A | 9/2000 | Mravic et al. |
| 6,136,105 | A | 10/2000 | Spencer |
| 6,248,150 | B1 | 6/2001 | Amick |
| 6,270,549 | B1 | 8/2001 | Amick |
| 6,371,029 | B1 | 4/2002 | Beal |
| 6,447,715 | B1 | 9/2002 | Amick |
| 6,457,417 | B1 | 10/2002 | Beal |
| 6,527,824 | B2 | 3/2003 | Amick |
| 6,551,376 | B1 | 4/2003 | Beal |
| 6,581,523 | B2 | 6/2003 | Beal |
| 6,591,730 | B2 | 7/2003 | Beal |
| 6,815,066 | B2 | 11/2004 | Elliott |
| 6,884,276 | B2 * | 4/2005 | Amick ..... 75/248 |
| 2003/0161751 | A1 | 8/2003 | Elliott |
| 2003/0164063 | A1 | 9/2003 | Elliott |

FOREIGN PATENT DOCUMENTS

| | | |
|---|---|---|
| EP | 0 062 337 | 10/1982 |
| FR | 2 672 619 | 8/1992 |
| GB | 731237 | 6/1955 |
| GB | 2149067 | 6/1985 |
| JP | 52-68800 | 6/1977 |
| JP | 59-6305 | 1/1984 |
| JP | 1-142002 | 6/1989 |
| WO | WO 96/11762 | 4/1996 |
| WO | WO 97/27447 | 7/1997 |
| WO | WO 01/06203 | 1/2001 |

OTHER PUBLICATIONS

"Steel 3-inch Magnum Loads Our Pick For Waterfowl Hunting," *Gun Tests*, Jan. 1998, pp. 25-27.

J. Carmichel, "Heavy Metal Showdown," *Outdoor Life*, Apr. 1997, pp. 73-78.

"Federal's New Tungsten Pellets," *American Hunter*, Jan. 1997, pp. 18-19, 48-50.

English-language abstract of European Patent No. EP 062 337, Derwent Publications, Ltd., 1987.

English-language abstract of French Patent No. FR 2 672 619, Derwent Publications, Ltd., 1988.

* cited by examiner

METHODS FOR PRODUCING MEDIUM-DENSITY ARTICLES FROM HIGH-DENSITY TUNGSTEN ALLOYS

RELATED APPLICATION

This application is a continuation of and claims priority to U.S. patent application Ser. No. 10/238,770, which was filed on Sep. 9, 2002, issued on Apr. 26, 2005 as U.S. Pat. No. 6,884,276, and which is a continuation of U.S. patent application Ser. No. 09/483,073, which was filed on Jan. 14, 2000, and issued on Sep. 10, 2002 as U.S. Pat. No. 6,477,715. The complete disclosures of the above-identified patent applications are hereby incorporated by reference for all purposes.

FIELD OF THE INVENTION

The present invention relates generally to tungsten alloy articles, and more particularly to methods for producing medium-density tungsten alloy articles from high-density tungsten alloy, such as recycled tungsten alloy scrap.

BACKGROUND AND SUMMARY OF THE INVENTION

Conventional powder metallurgy has been used for many years to produce a variety of tungsten-based alloys with densities approaching that of pure tungsten (19.3 g/cc). These alloys are collectively referred to as "WHA's" (i.e., tungsten heavy alloys) and typically have densities in the range of approximately 15 g/cc to approximately 18 g/cc). Examples of these alloys include, but are not limited to, W—Cu—Ni, W—Co—Cr, W—Ni—Fe, W—Ni, and W—Fe. Regardless of which alloy family is to be produced, the basic procedure is the same: appropriate proportions, chemical compositions and particle sizes of metallic powders are blended together, pressed into desired shapes, and finally sintered to yield consolidated material with desired physical and mechanical properties. WHA alloys are widely produced for use in such articles as counterweights, radiation shields, aircraft stabilizers, and ballast weights.

Following the initial processing described above, it is common practice to convert the sintered shapes to products of final dimensions and finishes by such processes as forging, swaging, drawing, cropping, sawing, shearing, and machining. Operations such as these inherently produce a variety of metallic scrap, such as machine turnings, chips, rod ends, broken pieces, rejected articles, etc., all of which are generated from materials of generally high unit value because of their tungsten content. Despite this value, however, it has proven difficult to recycle this WHA scrap other than by methods that employ chemical processes to recover the tungsten, which then must be reformed into a WHA. Often times, these processes also produce chemical waste streams, which raise environmental and health concerns as well as requiring treatment and disposal.

Examples of these chemical recovery processes include oxidation/reduction, anodic dissolution of secondary elements and dissociation by molten zinc. Oxidation/reduction involves oxidizing the WHA scrap in a high-temperature oxidizing environment that converts the alloy into mixed metal oxides, in which tungsten is present as tungsten trioxide. The mixed metal oxides are separated via chemical processes to isolate the tungsten trioxide alone or in combination with selected ones of the metal oxides. The isolated oxides are subsequently reduced to elemental tungsten or a mixture of metallic powders. This process requires special furnaces operating at temperatures in excess of 1000° C. in a dry hydrogen atmosphere free of any oxygen-containing substances. The reduction reaction consists of the reaction of hydrogen with the metal oxides, thereby producing water and elemental metal as products. Although this process is widely used, it is energy-intensive, relatively dangerous because of the high-temperature hydrogen used therein and expensive. Also, when larger WHA scrap pieces are used, the process becomes impractical because of the low surface-to-volume geometries of such pieces of WHA. Essentially, it is necessary to oxidize the pieces for a time, mechanically remove the oxide from the surfaces, and then repeat the process until the metal has been fully oxidized to its core.

Another chemical method is anodic dissolution, which consists of placing solid pieces of WHA scrap in a perforated stainless steel basket. The basket forms the anode in an electrolytic cell, with the electrolyte being sulfuric acid. Electrolysis at controlled voltages produces dissolution of the secondary elements in the WHA scrap, such as iron, nickel, copper, etc., and leaves behind a porous friable skeletal structure of tungsten-rich material that may be ground to powder for subsequent recycling. In addition to being relatively slow and energy-intensive, it also generates sulfuric acid wastes contaminated with undesirable metallic ions.

One other known chemical process is referred to as dissolution of secondary elements by molten zinc and involves exposing WHA scrap to molten zinc for periods of time sufficient to cause dissolution of elements other than tungsten in the liquid metal phase. The pregnant zinc liquid is physically separated from the solid tungsten residues, then vaporized and distilled to reclaim the various secondary metals and the zinc itself, which is subsequently recycled. This method has the disadvantages of potential pollution and health problems associated with handling zinc vapors and chemical waste disposal concerns associated with the secondary metals, several of which are viewed as "toxic heavy metals."

Therefore there is a need for an economical method for recycling WHA materials, and especially WHA scrap, into useful articles. The present invention relates to methods for producing medium-density articles from recovered high-density tungsten alloy (WHA) material, and especially from recovered WHA scrap. In one embodiment of the invention, the method includes forming a medium-density alloy from WHA material and one or more medium- to low-density metals or metal alloys. In another embodiment, medium-density grinding media, such as formed from the above method, is used to mill WHA scrap and one or more matrix metals into particulate that may be pressed and, in some embodiments, sintered to form medium-density articles therefrom.

Many other features of the present invention will become manifest to those versed in the art upon making reference to the detailed description which follows and the accompanying sheets of drawings in which preferred embodiments incorporating the principles of this invention are disclosed as illustrative examples only.

DETAILED DESCRIPTION OF THE INVENTION

Figure 2:
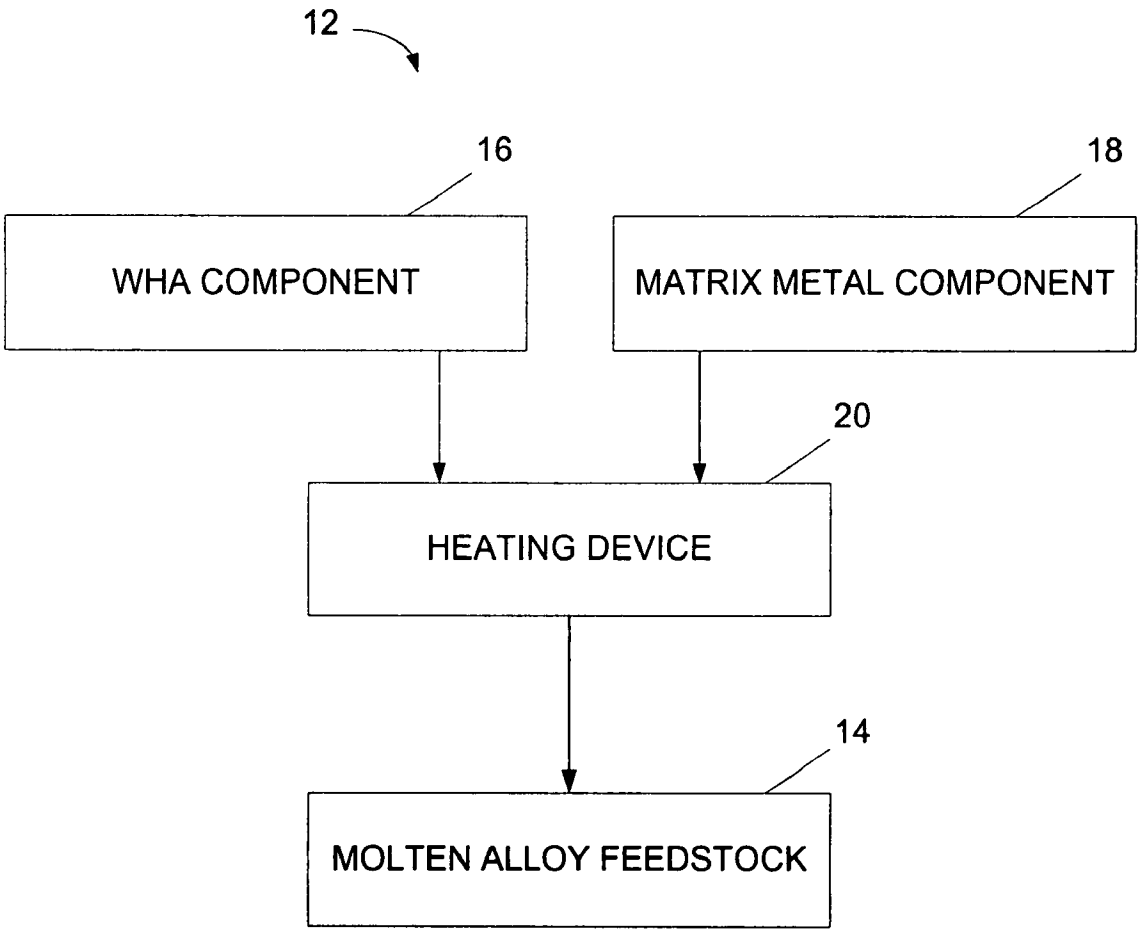
FIG. 2 is a flowchart illustrating in more detail the step of preparing the molten alloy feedstock of FIG. 1.
Figure 1:
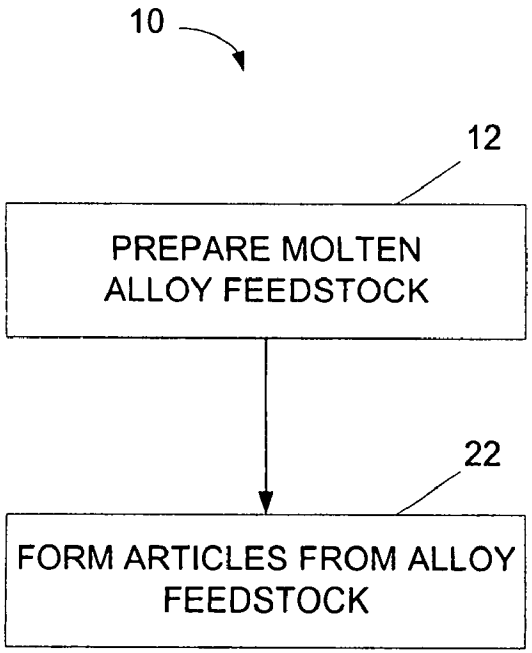
FIG. 1 is a flowchart illustrating a method for forming medium-density articles from high-density WHA material according to the present invention.

A method for forming medium-density articles from high-density WHA material is schematically illustrated at 10 in the flowchart of FIG. 1. At 12, a molten feedstock alloy 14 is prepared. As shown in FIG. 2, alloy 14 is formed from a WHA component 16 and a matrix metal component 18 that are dissolved into a molten metal solution. Matrix metal component 18 typically will be a medium- or low-density metal. As used herein, medium-density is meant to refer to densities in the range of approximately 8 g/cc to approximately 15 g/cc. The feedstock alloy is formed by dissolving one or more tungsten and/or WHA materials forming WHA components 16 in one or more medium- to low-density materials, referred to herein as matrix metals and alloys thereof, which form matrix metal component 18.

WHA components 16 may be formed from any suitable tungsten or tungsten alloy material, from virgin powders to relatively large scrap or otherwise usable pieces. In practice, it is expected that the most economical WHA component will be WHA scrap. Examples of common WHA scrap include WHA machine turnings, chips, rod ends, broken pieces, and rejected articles. Therefore, components 16 may include relatively fine WHA powder, but may also include larger remnants and defective or otherwise recyclable WHA articles.

Matrix metals 18 include any suitable metal, alloy or combination thereof into which WHA materials 16 will dissolve to form feedstock alloy 14. A non-exclusive list of suitable matrix metals includes zinc, tin, copper, bismuth, aluminum, nickel, iron, chromium, cobalt, molybdenum, manganese, and alloys formed therefrom, such as brass and bronze. Softer matrix metals such as copper, zinc, tin and alloys thereof have proven particularly effective, especially when articles formed from alloy 14 are formed without sintering, as discussed in more detail below.

It should be understood that the particular matrix metals and quantities thereof to be used may vary, depending for example upon the desired physical and mechanical properties of feedstock alloy 14 and the articles produced therefrom. For example, it may be desirable for alloy 14 to be magnetic, to have a certain density, to be frangible or infrangible, to have a selected ductility or hardness, to have a selected resistance to corrosion, or any other characteristic or property that may be obtained through selection of a particular quantity and composition of components 16 and 18. As discussed above, the matrix metals have a density less than that of the high-density WHA components, typically in the range of approximately 7 g/cc to approximately 15 g/cc, with many such materials having densities in the range of approximately 8 g/cc to approximately 11 g/cc.

The matrix metals forming the medium- to low-density components also have melting points that are less than the melting point of WHA materials 16, which are typically in excess of 2000° C. Perhaps more importantly, the resulting alloy formed from components 16 and 18 has a melting point that is less than the WHA components. This enables molten alloy 14 to be formed at temperatures much lower than the temperatures required to melt WHA materials alone.

Any suitable heating device 20 may be used to form molten alloy 14 by dissolving the WHA components into the other components. It should be understood that the required operating temperature of the device being used will vary depending upon the particular metals being dissolved to form alloy 14. For most conventional heating devices 20, such as induction heaters, forming alloy 14 with a matrix metal component concentration in the range of approximately 20% and approximately 70% has proven effective, with a concentration of at least approximately 30% being presently preferred. In these ranges, alloy 14 has a resulting melting point within the range normally achievable by an induction heater. As a general rule, the lower the concentration of WHA components in the resulting alloy, the lower the melting point of the alloy. However, higher melting point alloys, such as those with matrix metal concentrations lower than the ranges described above, may be created with an induction furnace so long as the refractive elements of the furnace are capable of sustaining the temperature required to form the alloy. Similarly, as the concentration of tungsten in the alloy is increased, the density of the alloy will also increase. By way of illustrative example, when alloy 14 contains 50% tungsten, it will generally have a density in the range of approximately 11 g/cc to approximately 11.5 g/cc. When it has a tungsten content of 55^%, the alloy will generally have a density in the range of approximately 12 g/cc.

An induction furnace offers the additional advantage that it produces stirring of the molten feedstock alloy resulting from the continuous or periodic application of induction currents to the alloy. This prevents gravity segregation, which is the general separation, or concentration, of higher and lower density materials at the lower and upper regions of the container, respectively, especially as the alloy cools. Gravity segregation results in the density and properties of the feedstock alloy varying, depending upon the particular composition of the alloy from which a sample is drawn. Any other suitable method for stirring the alloy may be used. Molten feedstock alloy 14 may also be formed through arc melting (open air, special atmosphere or vacuum), as well as with a resistance furnace, so long as the heating element used in the furnace is capable of withstanding the required operating temperatures. Other lower temperature processes may be used as well, so long as they can produce the molten alloy described herein. For example although currently expensive, cold-wall induction melting devices should be able to produce molten alloy 14

In practice, melting non-WHA components 18 and then incrementally adding WHA components 16 has proven to be an effective method for forming molten alloy 14. This results in the WHA components being continuously and progressively dissolved in the molten "matrix" while maintaining a generally homogeneous liquid phase before additional WHA material is added. However, it is within the scope of the present invention that the WHA components may be added as a unit to the non-WHA components, or that all of the components may be mixed before being dissolved into the metal solution forming alloy 14.

Figure 3:
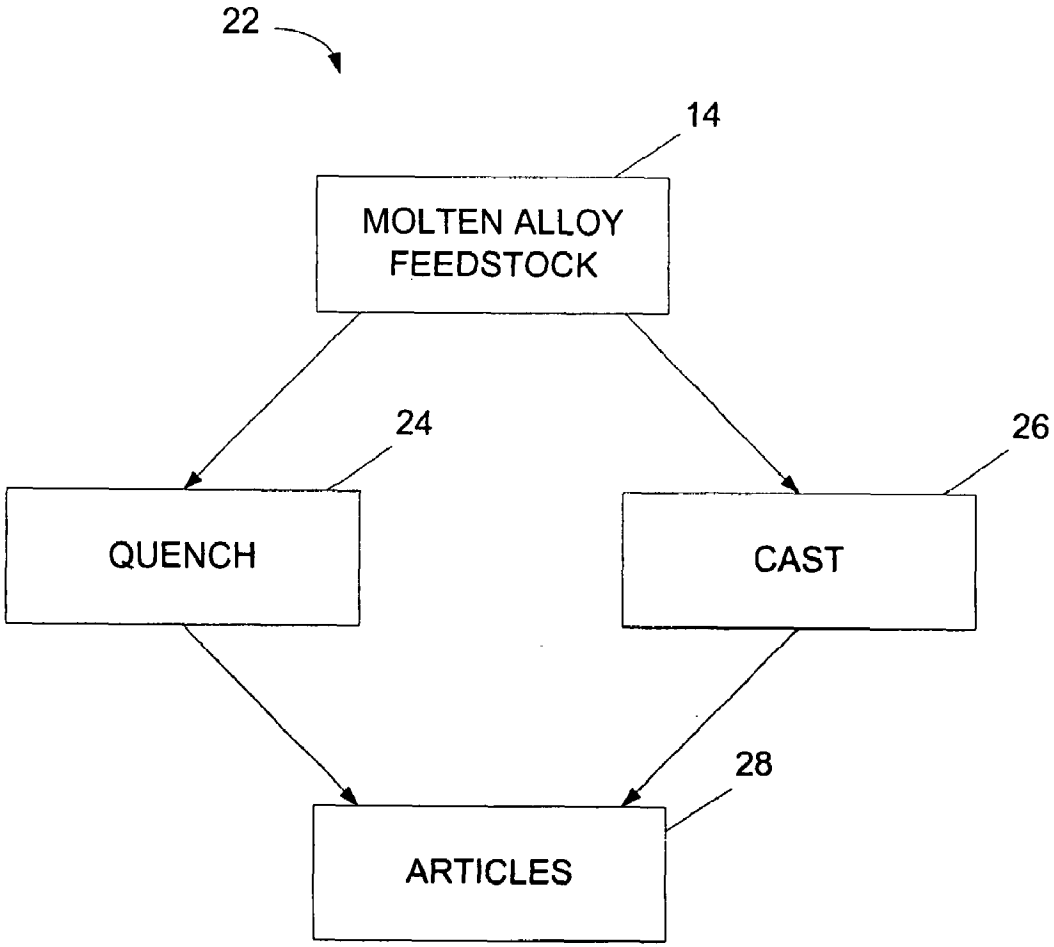
FIG. 3 is a flowchart illustrating in more detail the step of forming articles from the molten alloy feedstock of FIG. 1.

Once the molten feedstock alloy is prepared, articles may be produced therefrom, as indicated generally at 22 in FIG. 1 and illustrated in more detail in FIG. 3. Examples of suitable methods for forming articles from the molten alloy include quenching and casting, which are generally indicated in FIG. 3 at 24 and 26, respectively. Quenching involves rapidly cooling droplets or other volumes of molten alloy 14 by dropping or otherwise introducing it into a quenching fluid, such as water. This results in generally spherical quenched articles. Casting, on the other hand, involves pouring or otherwise depositing molten alloy 14 into a mold that defines the general shape of the cast article produced therein. Any suitable method for implementing the casting and quenching steps of FIG. 3 may be used. The articles produced by these methods, or the subsequently described methods of FIGS. 5-9 are generally indicated at 28 in FIG. 4. It should be understood that some embodiments of the methods may be more well-suited for forming particular articles than others. For example, the methods of FIGS. 5-9 have proven more effective for forming infrangible bullets than the methods of FIGS. 1-3. Similarly, the methods of FIGS. 5-9 are also more effective for forming articles that exhibit the deformation characteristics of lead.

Figure 4:
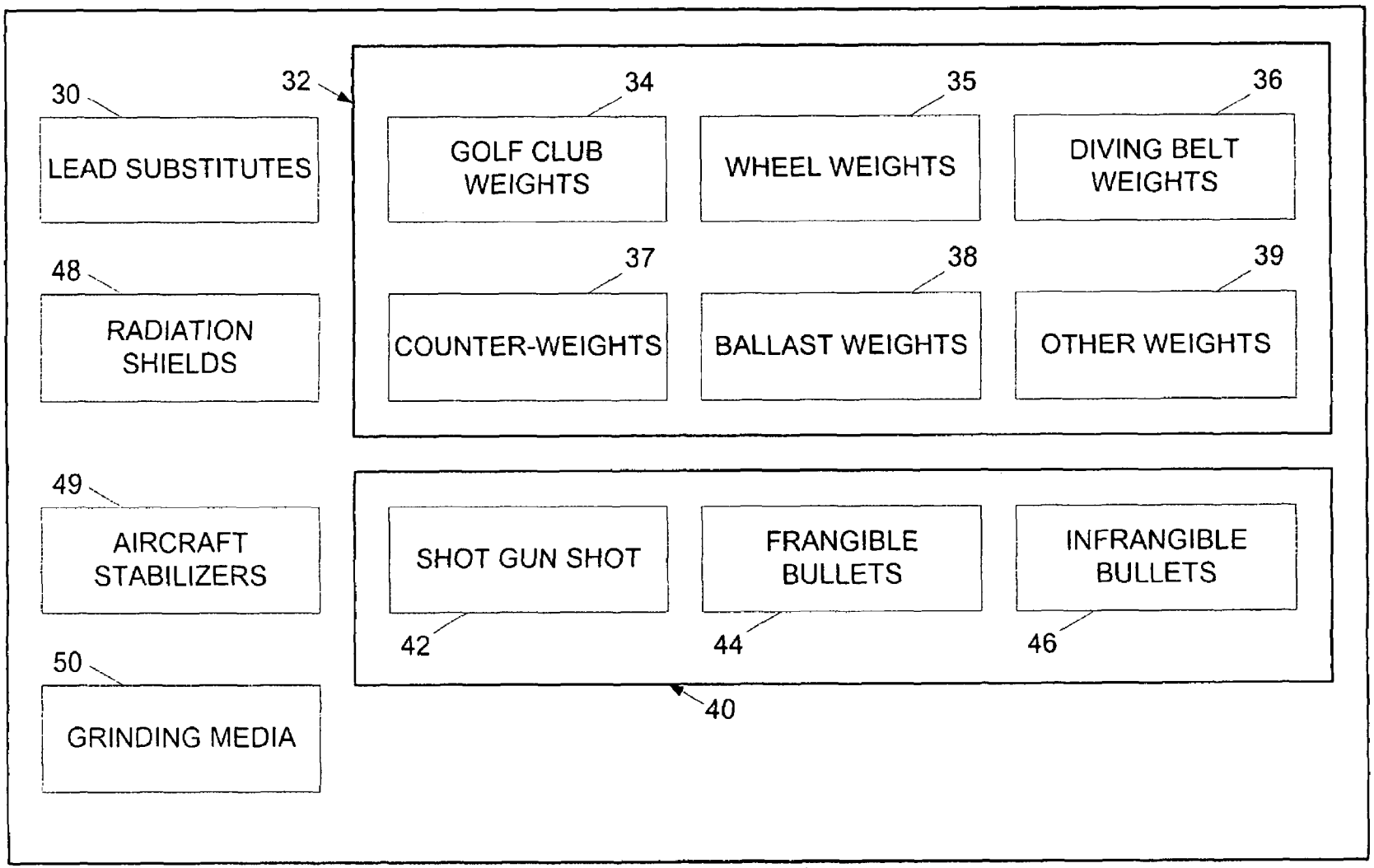
FIG. 4 is a schematic view of articles produced by the forming steps of the methods of the present invention.

As discussed above, the articles produced by the method of FIGS. 1-3, enable high-density WHA materials, and especially high-density WHA scrap materials, to be efficiently recycled into medium-density articles. Similar to the subsequently described milling process, the articles are produced without requiring chemical processing, and without involving processes that produce environmental or health hazards. Examples of medium-density articles that may be produced by the methods of the present invention are shown schematically in FIG. 4. It should be understood that the examples shown in FIG. 4 are for purposes of illustration and that the methods of the present invention may be utilized to make articles other than those shown in FIG. 4.

Because the density of the produced articles is in the range of approximately 8 g/cc to approximately 15 g/cc, one class of article that may be produced by the present invention is lead substitutes 30. More particularly, lead has a density of 11.3 g/cc and through selection of the proper compositions and proportions of the WHA and metal matrix components 16 and 18 used to form alloy 14, the articles may have a density which equals or approximates that of lead. For example, articles may be produced with densities in the range of approximately 9.5 g/cc to approximately 13 g/cc. Substitutes 30 have densities at or near that of lead. Furthermore, the articles produced by the methods of the present invention do not exhibit the toxicity of lead, which raises environmental and health concerns and is banned from use in many products. It should be understood that lead substitutes 30 form a relatively broad class of articles and may overlap with some of the other articles described herein. Also, because articles produced from the methods of the present invention do not exhibit the toxic and other health concerns of lead-based products, articles produced therefrom may be used in applications where lead-based articles cannot.

Because of the relatively dense structure of the medium-density articles produced by the methods disclosed herein, another class of useful article produced therefrom is weights 32. For example, alloy 14, or the subsequently described milled particulate, may be used to form golf club weights 34, wheel weights 35, diving belt weights 36, counterweights 37, ballast weights 38, other weights 39, etc. Weights 32 may be formed by quenching, casting or any other suitable process, depending for example upon the desired size and shape of the weights.

Another class of articles that may be formed from the methods of the present invention are firearm projectiles 40. Examples of such projectiles 40 include shotgun shot 42, frangible bullets 44 and infrangible bullets 46. Frangible bullets 44 remain intact during flight, but disintegrate into small fragments upon impact with a relatively hard object. These bullets also may be described as being non-ricocheting bullets because they are hard enough to penetrate into a living creature, but will not penetrate into walls or other hard objects. Shotgun shot typically will be formed by quenching, with bullets and some larger shot typically being formed by casting.

Projectiles 40 may also be selectively ferromagnetic or non-ferromagnetic, depending upon the particular components and relative proportions used to form alloy 14 or the subsequently described milled particulate. Because lead is not magnetic, producing magnetic projectiles 40 provides a useful mechanism for determining whether the projectile is a lead-based projectile or not. For example, the use of lead in shotgun shot was banned in 1996. However, some hunters still prefer to use lead shot because it is relatively inexpensive and shot made from other materials has not proven either performance- or cost-effective, especially for larger caliber shot, such as used to hunt geese. A magnet enables a game warden or other individual to test whether the shot being used by a hunter is lead-based shot. It is within the scope of the invention that any of the articles described herein also may be magnetic, depending upon the particular components used therein.

Other examples of articles 28 include radiation shields 48 and aircraft-stabilizers 49. Still another medium-density article that may be produced by the methods of FIGS. 1-3 is a grinding medium 50, which may be formed by quenching or casting. Because of its density and hardness, medium 50 is particularly well-suited for milling other hard materials that would otherwise damage and wear away grinding media formed from conventional materials, such as high-chromium steel, thereby contaminating the particulate formed thereby.

Figure 5:
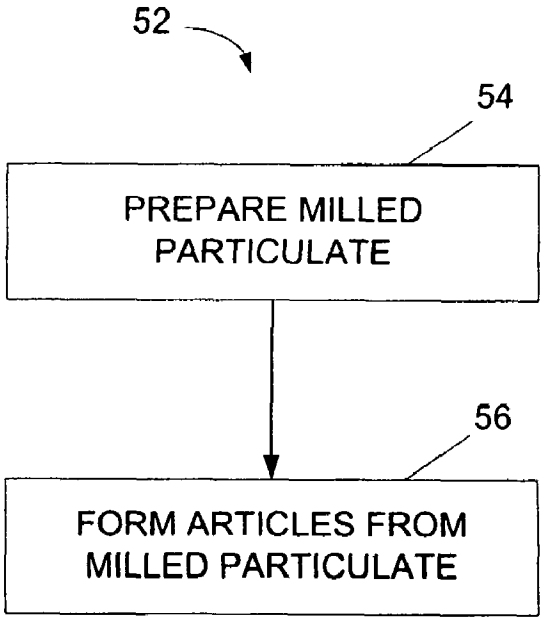
FIG. 5 is a flowchart illustrating another method for forming medium-density articles from high-density WHA material according to the present invention.
Figure 6:
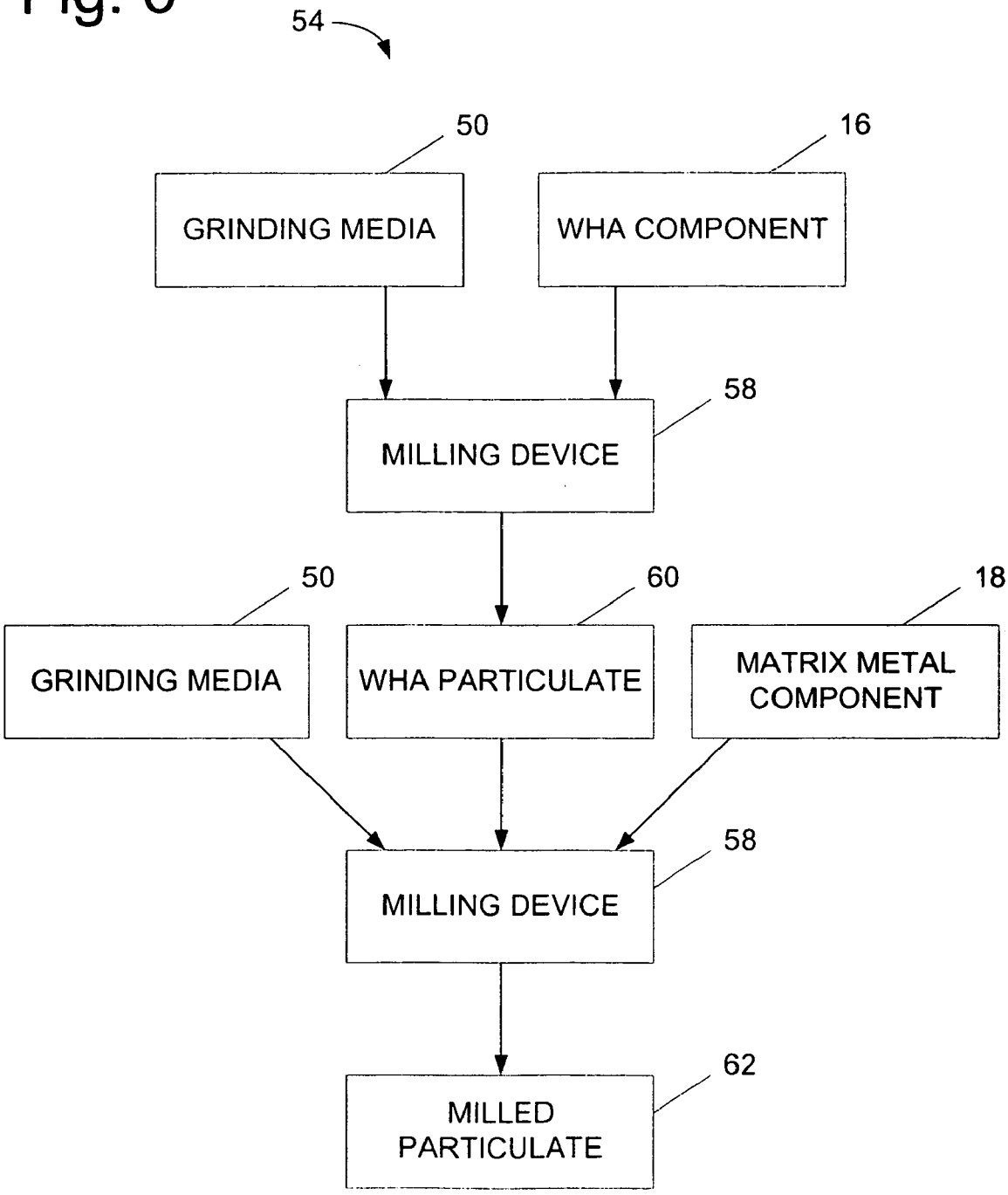
FIG. 6 is a flowchart illustrating in more detail the step of preparing the milling feedstock of FIG. 5.

In FIG. 5, another method for producing medium-density articles from high-density WHA materials is illustrated generally at 52. Method 52 includes preparing milled particulate at 54, and then forming articles therefrom at 56. Similar to the methods of FIGS. 1-3, method 52 combines a high-density WHA component 16 with a medium- to low-density metal matrix component 18 to produce a medium-density article therefrom. A flowchart illustrating a first embodiment of this method in more detail is shown in FIG. 6. As shown, grinding media 50, which preferably is produced by one of the previously described methods, and a WHA component 16 are added to a milling device 58. In this milling method, WHA media preferably includes smaller WHA materials, or scrap, such as turnings, flakes and chips. The output from milling device 58 is referred to herein as WHA particulate 60. Particulate 60 typically has an irregular flake-like appearance, as opposed to virgin WHA powder, which is considerably smaller and more regular in appearance.

Any suitable milling device 58 may be used, such as batch and continuous discharge mills. In experiments, high-energy ball mills and attritors have proven effective. Because grinding media 50 and WHA component 16 have the same or similar compositions, densities and hardness, this milling process may be described as autogenous milling. Wear on grinding media 50 will be substantially reduced as compared to wear on conventional grinding media, such as high chromium steel. Furthermore, any portions of grinding media 50 that are worn away through the milling process simply increase the amount of the produced WHA particulate 60, with little, if any, change in the composition and/or properties of the particulate.

To produce medium-density articles from high-density WHA particulate 60, the particulate is again milled with a suitable grinding media, such as media 50, and a matrix metal component 18 to produce a medium-density milled particulate 62. It is within the scope of the present invention that this second milling step may alternatively include blending or otherwise mixing the particulate and metal component 18 without requiring grinding media or the like. For example when metal component 18 is a powder, including relatively coarse or large-grained powders, or a particulate, the second milling step may be accomplished simply by mixing or blending the components. When grinding media or the like is employed, metal component could also include chips or other larger-size particles or pieces, which will be reduced in size by the grinding media, similar to the WHA component being reduced to particulate.

Figure 7:
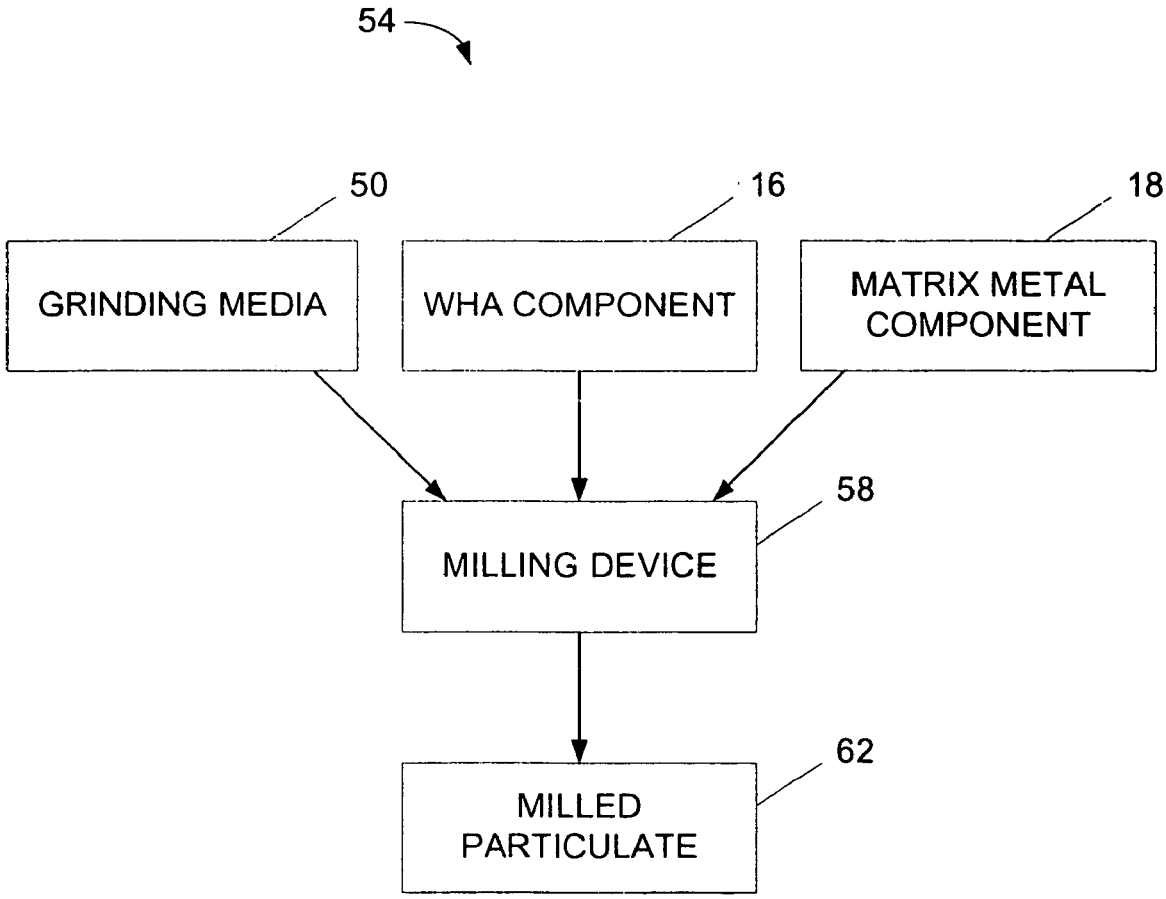
FIG. 7 is a flowchart illustrating another embodiment of the method shown in FIG. 6.

A variation on this method is shown in FIG. 7, where the WHA and matrix metal components 16 and 18 are added to the milling device at the same time, instead of-the two-step milling process illustrated in FIG. 6.

It is also within the scope of the present invention that the grinding media used in the methods of FIGS. 5-7 may be recovered WHA scrap, such as bar ends, defective or otherwise unused WHA articles, etc.

Figure 8:
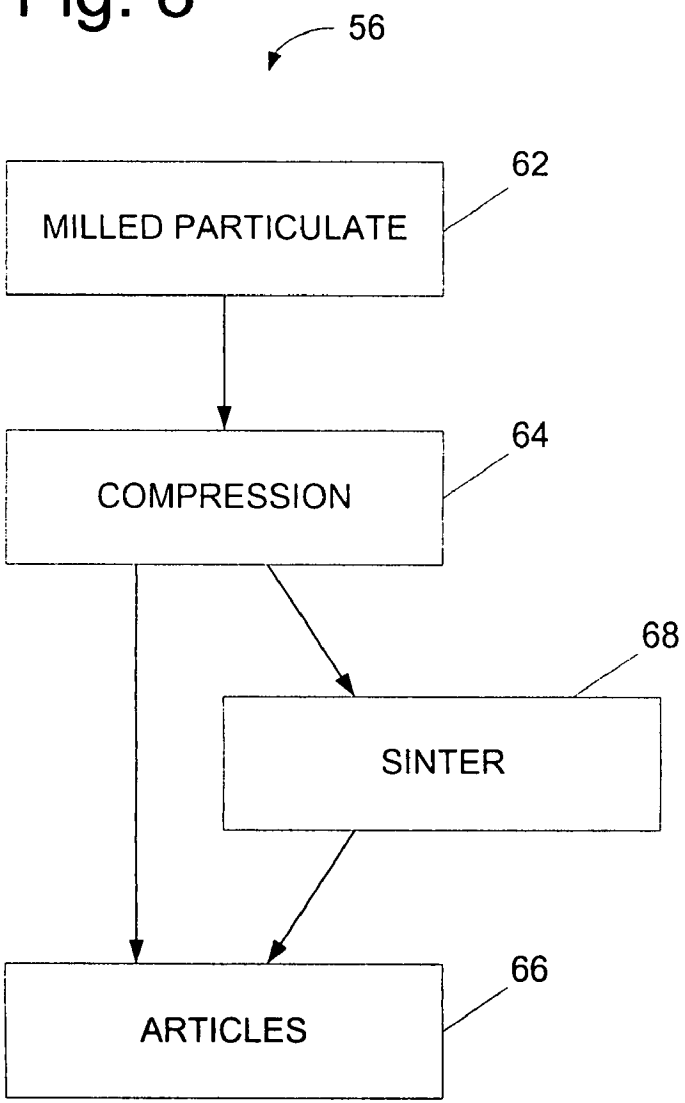
FIG. 8 is a flowchart illustrating in more detail the step of forming articles from the milled particulate of FIG. 5.

In FIG. 8, a method for forming medium-density articles 66 from milled particulate 62 is shown. It should be understood that any of the articles described above with respect to FIG. 4 may be formed from the methods of FIG. 8. Although, pure WHA particulate has proven to exhibit poor compactability, resulting in products with relatively low-densities and unacceptable porosity, mixing WHA particulate with one or more medium- to low-density matrix metals 18 overcomes these difficulties. These articles may also exhibit the deformation characteristics of lead, depending upon the particular compositions and quantities thereof in the particulate from which the article is formed. One method for forming these articles is simply by compressing the milled particulate into an article with a desired shape. In this article, the WHA particulate may be thought of as providing strength and continuity to the article, with the soft matrix metal or metals providing ductility and adherency. As shown at 68, it may be desirable to sinter the milled particulate after compression to increase the strength of the article. Experiments have shown that harder matrix metals tend to require sintering, while soft matrix metals like zinc, copper and tin may be used to form articles with or without sintering.

Figure 9:
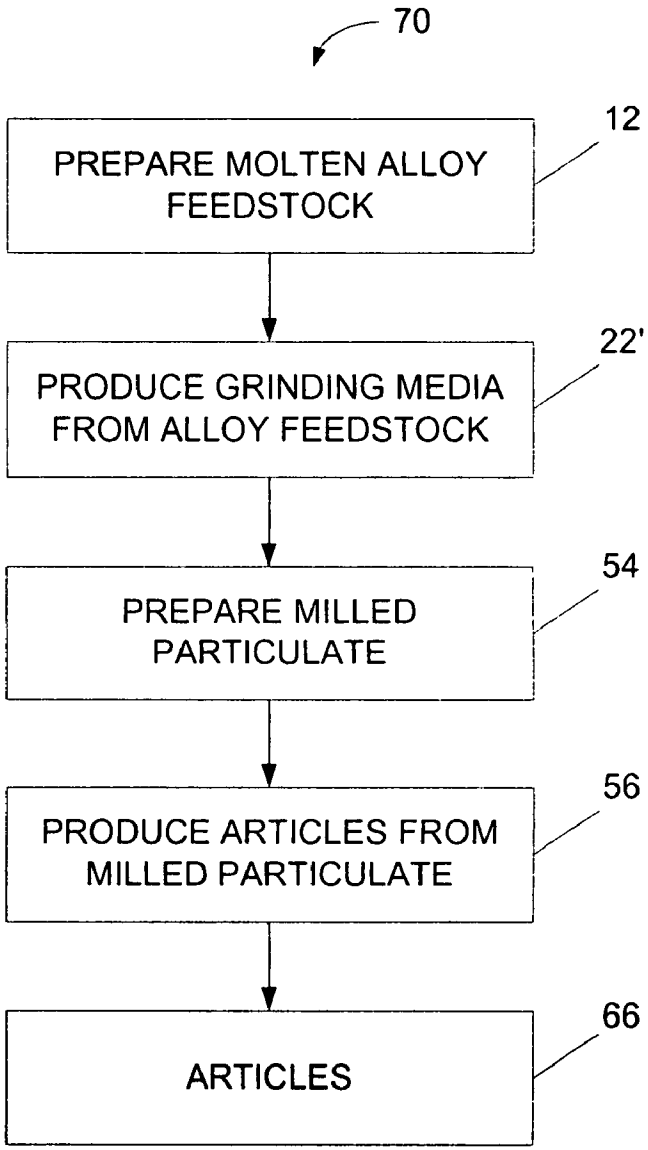
FIG. 9 is a flowchart illustrating another method for forming medium-density articles from high-density WHA materials according to the present invention.

In FIG. 9, a further method for producing medium-density articles from high-density WHA materials is illustrated and indicated generally at 70. Method 70 essentially combines the previously described steps shown in FIGS. 1 and 5. In brief summary, at 12 a molten alloy feedstock is produced from a high-density WHA component and a medium- to low-density matrix metal component. At 22', grinding media is formed from the molten alloy feedstock, such as by quenching or casting. At 54, the produced grinding media is utilized in a milling device to produce milled particulate 62 from a WHA and metal matrix components 16 and 18. At 56, medium-density articles 66 are produced from the milled particulate, such as through compression or compression and sintering.

EXAMPLES

Example 1

Approximately 5.0 lb. of WHA machine turnings (90% W-7% Ni-3% Fe by weight) were milled in a 12-in. diameter by 18-in. long ball mill containing 30 lb. of 1.0-in. diameter alloy steel balls and dry-milled at 50 rpm for 11 hours. At the end of the run, only approximately 15% of the turnings had been ground small enough to pass through a 100-mesh screen. This experiment demonstrated the extreme resiliency and wear-resistance of the turnings and indicated that conventional milling would not be effective to produce WHA particulate from WHA scrap.

Example 2

A charge of 5.0 lb. of the turnings used in Example 1 was dry-milled in a high-energy Union Process 1S attritor ("stirred ball mill") with about 20 lb. of 50% W-35% Ni-15% Fe cast grinding media. The grinding media was produced by the method of FIG. 1 and had diameters of approximately ¼-in. Milling was carried out at 500 rpm for 2 hours. About 50% of the WHA particulate so produced passed through a 100-mesh screen. After 2 additional hours of milling, only about 10% of the original material remained on a 100-mesh screen. Examination of ground particles under a binocular microscope revealed generally flat flakes and fibers with acicular and irregular shapes.

Example 3

Attrition-milled particulate from Example 2 was blended with zinc particulate to form a mixture of 80% WHA-20% Zn. The mixture was then pressed in a steel die at 20,000 psi to produce a compact 1¼ in. diameter by 0.5 in. thickness article with a bulk density of 10.77 g/cc. The article exhibited plastic deformation upon deforming it with a hammer. Reduction in thickness of about 30% was achieved prior to failure. Fracture surfaces were associated with loose "crumbs" of material, the largest of which were approximately 100-mesh.

Example 4

Two different mixtures of the coarsest fraction (>100-mesh) of milled WHA particulate were mixed with 30% zinc and 40% zinc powder, pressed in a steel die at 20,000 psi to yield articles of about 1√174 in. diameter by ¼ in. thickness and measured for bulk density. Density was 10.27 g/cc for the 30% zinc sample and 9.74 g/cc for the 40% zinc sample. Again, deformation with a hammer showed these articles to be ductile, the degree of deformation prior to fracture being somewhat greater in the sample with higher zinc content. The presence of discrete acicular particles in fracture regions again indicated that stressing to fracture resulted in extensive "frangibility."

Example 5

Mixtures of 70% attrition-milled WHA particulate from Example 2 with 30% of three different soft metal powders (copper, tin and nickel) were compacted in the manner of Examples 3 and 4. In all three cases, ductile articles were produced, although the nickel version was not as ductile as the copper and tin versions. In general, these articles exhibit deformation behavior and fracture modes similar to those previously observed in WHA-Zn mixtures. Bulk densities were about 10.8 g/cc for the copper and nickel versions, and 10.2 for the tin versions.

Example 6

A mixture of 70% attrition-milled particulate from Example 2 with 30% Zn powder was flowed into a 0.30 caliber rifle cartridge jacket (97% Cu-3% Zn, 0.020 in. wall) and compacted with a tool-steel punch at about 30,000 psi. The compacted bullet had a bulk density of about 9.8 g/cc, a value that is comparable to the bulk densities of conventional copper-jacketed lead bullets.

Example 7

To explore the potential for producing unique, "nanostructured" powders from WHA chips, a 20-gram mixture of 70% WHA chips with 30% zinc powder was aggressively milled for 2 hours in a "high-energy" SPEX mill, using pieces of heavy WHA scrap as grinding media. By "nanostructured," it is means that particle dimensions, which are on the order of nanometers, are so small that the number of metal atoms associated with grain boundaries are equal to, or greater than, the number of geometrically ordered interior atoms. Such materials have very different properties from those of larger-grained, conventional metals and alloys.

Approximately 1.0% of a stearate lubricant was included in the mixture to prevent particle agglomeration on the container walls. X-ray diffraction analysis revealed that all traces of zinc peaks had disappeared from the product, while the major tungsten peaks had shifted slightly to increased "two-theta" values. The conclusion was that significant mechanical alloying effects had been obtained, producing a non-equilibrium solid solution of zinc in tungsten. (Phase diagrams indicated that there is no solubility of zinc in tungsten under conditions of thermal equilibrium.)

While the invention has been disclosed in its preferred form, the specific embodiments thereof as disclosed and illustrated herein are not to be considered in a limiting sense as numerous variations are possible. It is intended that any singular terms used herein do not preclude the use of more than one of that element, and that embodiments utilizing more than one of any particular element are within the spirit and scope of the present invention. Applicant regards the subject matter of the invention to include all novel and non-obvious combinations and subcombinations of the various elements, features, functions and/or properties disclosed herein. No single feature, function, element or property of the disclosed embodiments is essential to all embodiments. The following claims define certain combinations and subcombinations that are regarded as novel and non-obvious. Other combinations and subcombinations of features, functions, elements and/or properties may be claimed through amendment of the present claims or presentation of new claims in this or a related application. Such claims, whether they are broader, narrower or equal in scope to the original claims, are also regarded as included within the subject matter of applicant's invention.

I claim:

1. A method for producing tungsten-containing firearms projectiles, the method comprising:

producing a particulate from a supply of tungsten-containing scrap having a density of at least approximately 15 g/cc and having a composition formed from at least 70% of at least one of tungsten and a tungsten alloy, wherein at least a majority of the scrap is selected from the group consisting of machine turnings, chips, flakes, rod ends, broken articles and rejected articles;

mixing the particulate with at least a metallic component formed from at least one of a metal and an alloy having a density less than approximately 15 g/cc to produce a particulate product composition therefrom; and forming from the product composition a firearm projectile having a density in the range of approximately 8 g/cc to approximately 15 g/cc.

2. The method of claim 1, wherein the producing step includes milling the supply of tungsten-containing scrap with grinding media formed at least in part from at least one of tungsten and a tungsten alloy.

3. The method of claim 1, wherein the mixing step includes heating the product composition to form a generally homogenous solution and further wherein the forming step includes casting an article from the solution.

4. The method of claim 1, wherein the mixing step includes heating the product composition to form a generally homogenous solution and further wherein the forming step includes forming an article from the solution by quenching droplets of the solution.

5. The method of claim 1, wherein the forming step includes pressing, without sintering, the product composition into a firearms projectile having a density in the range of approximately 8 g/cc to approximately 15 g/cc.

6. The method of claim 1, wherein the forming step includes pressing and sintering the composition into a firearms projectile having a density in the range of approximately 8 g/cc to approximately 15 g/cc.

7. The method of claim 1, wherein the mixing step further includes mixing a high-density component having a density greater than 15 g/cc with the particulate and the metallic component.

8. The method of claim 1, wherein the supply of scrap is obtained without requiring chemical processing of the scrap to recover tungsten therefrom.

9. The method of claim 1, wherein the metallic component includes at least one of zinc, tin, copper, bismuth, aluminum, nickel, iron, chromium, cobalt, molybdenum, manganese, and alloys thereof.

10. The method of claim 9, wherein the metallic component includes at least one of copper, zinc, tin and alloys thereof.

11. The method of claim 10, wherein the metallic component includes at least one of tin and a tin alloy.

12. The method of claim 1, wherein the metallic component forms approximately 20-70% by weight of the alloy.

13. The method of claim 7, wherein the high-density component includes an alloy comprising tungsten, nickel and iron.

14. The method of claim 7, wherein the high-density component includes ferrotungsten.

15. The method of claim 7, wherein the high-density component includes tungsten.

* * * * *